United States Patent [19]

Bamford et al.

[11] 4,047,762

[45] Sept. 13, 1977

[54] GATHERING ARMS FOR A MINING MACHINE

[75] Inventors: Kenneth Bamford, East Markham, near Newark; John Roger Clowes, Mansfield, both of England

[73] Assignee: Dosco Overseas Engineering Limited, England

[21] Appl. No.: 669,835

[22] Filed: Mar. 24, 1976

[30] Foreign Application Priority Data

Apr. 14, 1975 United Kingdom ..... 15225/75

[51] Int. Cl.[2] ..... E21C 35/20

[52] U.S. Cl. ..... 299/64; 198/514; 299/75

[58] Field of Search ..... 299/64–67, 299/55, 56, 57; 198/10, 514

[56] References Cited

U.S. PATENT DOCUMENTS

| | | | |
|---|---|---|---|
| 2,099,981 | 11/1937 | Joy | 198/514 |
| 2,639,023 | 5/1953 | Goodrich | 198/514 X |
| 3,269,776 | 8/1966 | Munger | 299/67 X |
| 3,437,382 | 4/1969 | Meissner et al. | 299/64 X |

*Primary Examiner*—Ernest R. Purser

*Attorney, Agent, or Firm*—Diller, Brown, Ramik & Wight

[57] ABSTRACT

The invention relates to gathering arms for a mining machine to operate in conjunction with a forwardly extending apron to sweep mined material across the apron where it can be transferred by a conveyor to the rear of the machine. Although a single gathering arm is envisaged, preferably two are provided which are hydraulically operated by means of two pairs of piston and cylinder devices arranged to extend and retract the arms and sweep them between inboard and outboard positions after the style of extendable windscreen wiper blades, the arms being extended during a work sweep and retracted during a return sweep. The invention also extends to a hydraulic circuit for operating the arms largely automatically in synchronism and to a mining machine fitted with such arms.

8 Claims, 5 Drawing Figures

3
5
7
9
13
23
21
1
9
11

GATHERING ARMS FOR A MINING MACHINE

This invention relates to gathering arms for mining machinery, and to mining machinery having such gathering arms. The invention also relates to a fluid control system for the arms.

Certain types of mining machines, especially those provided with a turret-operated telescopic cutting head, allow the mined material to fall to the floor of the working and then, by advancing, gather it with a downwardly and forwardly inclined gathering apron, from which it is removed by means of an endless conveyor. Many different types of apron/conveyor construction are possible but the most common is probably to have an apron with a centrally located discharge conveyor, the apron being provided with a pair of gathering arms arranged to sweep material inwardly from the side of the apron to the centre so that as the machine is advanced, so the material will be loaded onto the inclined apron. Alternatively, one could have a side mounted conveyor, in which case a single gathering arm sweeping right across the apron might be sufficient.

Obviously, the gathering arm(s) should be capable of sweeping through a substantial angle from an outboard position to an inboard position and after sweeping has occurred the or each arm must be effectively shortened in length so that the arm(s) can be returned to an outboard position again, without sweeping the previously swept-in material off the apron. In the past, sweeping of the arm(s) and extension of the arm(s) has been achieved by mechanically operated linkages, most of which have incorporated one or more control cams. Obviously, the gathering arm(s) operate(s) almost continuously and therefore is or are subjected to considerable wear and tear with the result that the mechanisms wear out easily and are difficult and expensive to replace.

The present invention is aimed at cutting down on the wear and tear of the gathering arm mechanism(s) for mining machines.

According to the present invention, we provide, for use in a mining machine having a forwardly extending apron and a discharge conveyor associated with the apron, a gathering arm having a first end for pivotal connection to the machine, a first hydraulically operated device pivotally connected to the arm for sweeping the arm through a substantial arc between a first position and a second position, and a second hydraulically operated device supported on the arm for extending and retracting the arm so that it can be extended for sweeping from the first position to the second position and can be retracted again prior to sweeping back from the second position to the first position.

Preferably, each arm is extended by means of an internally located piston and cylinder device, and sweeping is performed by a piston and cylinder device pivotally connected to the arm at one end and the machine at its other end.

Also according to the invention, we provide a mining machine having at least one gathering arm as previously described.

Preferably, two gathering arms are provided which operate in synchronism so as to sweep from outboard positions to inboard positions. Preferably, the arms are mounted on an apron of the mining machine to enable mined material to be swept to the centre of the apron so that, as the machine is advanced, so the material can be gathered by the apron, and removed by a central conveyor.

Preferably, the mining machine has a hydraulic control system for controlling the sweeping and extension of the or each gathering arm, the system including a pump, a main control valve, a first detent valve movable between a first position, for extending the or each arm and for sweeping the or each arm from a first to a second position, and a second position for retracting the or each arm and for sweeping the or each arm back to its first position under the control of a second detent valve, said first detent valve, when in its first position, supplying fluid to the second i.e. the arm extending and retracting device to move it to an extended position, a first sequence valve operative, on movement of said device to its extended position, to permit passage of fluid to the first device to move it from a first position to a second position, a second sequence valve operative, on movement of said first device, to its second position to permit passage of fluid to the second detent valve controlling the position of the first detent valve to move the second detent valve from a first position to its second position to cause the first detent valve to move to its second position, whereupon fluid will be directed to the second, i.e. the arm extending and retracting device to move the latter from its extended position back to its retracted position, whereupon a third sequence valve will allow passage of fluid to the first device to return it from its second position to its first position, whereupon a fourth sequence valve will permit passage of fluid to the second detent valve to move it from its second position back to its first position, thereby causing the first detent valve to move back to its first position for a subsequent control cycle.

Preferably, supply of control fluid to the second detent valve is taken from a fluid line extending between the main control valve and the first detent valve.

Preferably, a fluid by-pass line and a non-return valve are associated with each sequence valve to allow passage of fluid to tank whenever one of the control devices changes position. Preferably, a spring loaded manual reversing valve is provided downstream of the first detent valve.

The device for moving the or each arm from its first position to its second position may be so mounted so as to do this either by a pulling operation or a pushing operation.

The invention is now described by way of example with reference to the accompanying drawings, in which.

Figure 1:
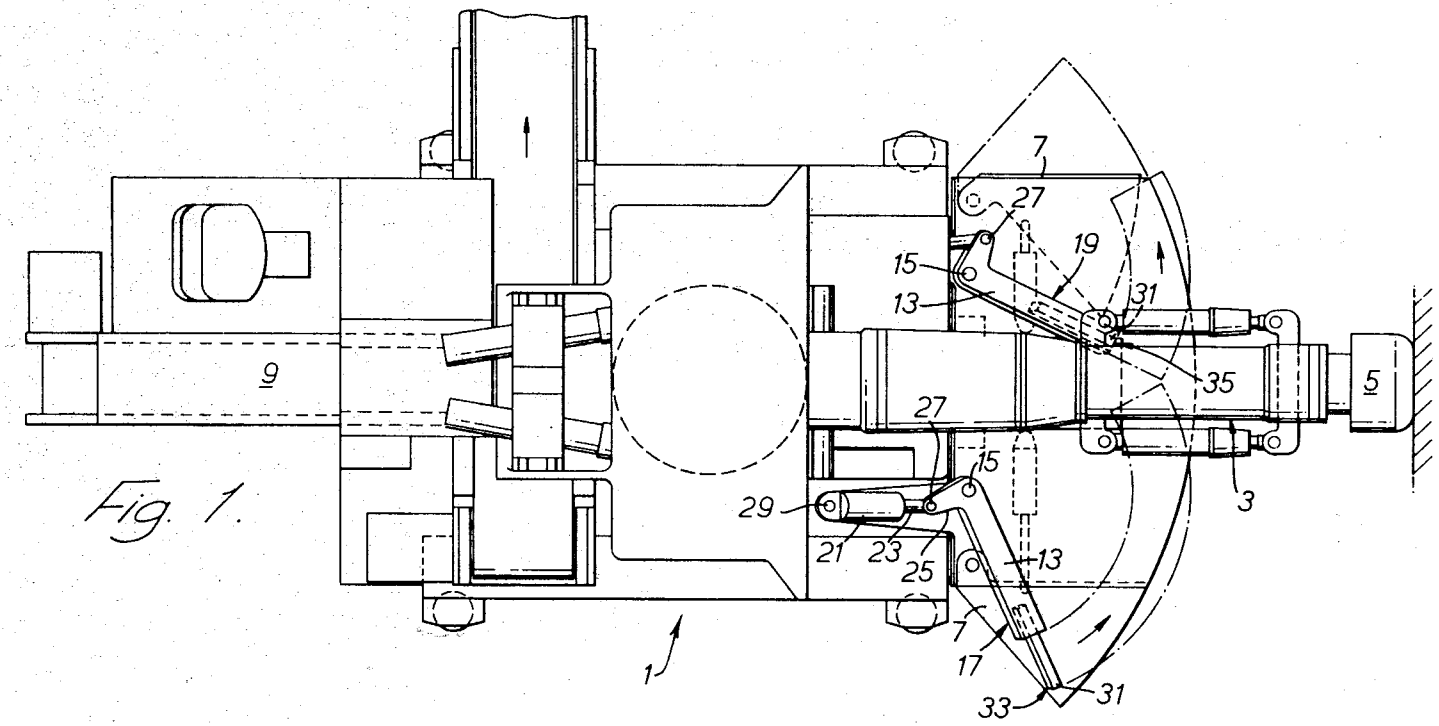
FIG. 1 is a plan view of a mining machine fitted with gathering arms, one gathering arm being shown schematically in its extended position and at one extreme sweep, i.e. outboard position, and the other gathering arm being shown in its retracted position and its other extreme sweep, i.e. inboard position.
Figure 2:
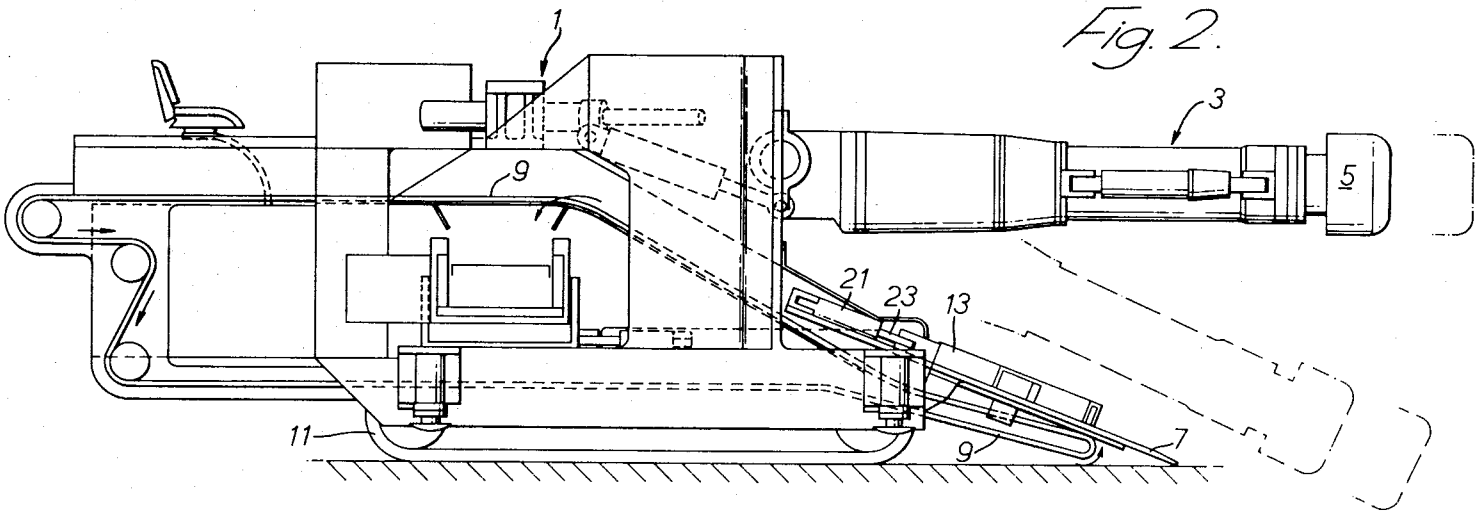
FIG. 2 is a side elevation.

Referring to FIGS. 1 and 2, a mining machine 1 is shown with a telescopic boom 3 having a cutting head 5 and beneath the boom is a generally fan-shaped apron 7 which, as can be seen from FIG. 2, is downwardly and forwardly inclined. Extending upwardly and rearwardly from the upper rear end of the apron 7 is an endless central discharge conveyor 9, and the mining machine is generally operated in known manner and provided with caterpillar tracks 11. A pair of gathering or sweeper arms 13 is associated with the apron 7 and the arms are mounted for sweeping or rocking movement about axes 15. The arms are identical and the operation of only one will be described, it being appreciated that normally the two would be operated in synchronism. Each arm is arranged to sweep over the surface of the apron 7 from an outboard position shown generally at 17 to an inboard position shown generally at 19, this sweeping movement being under the control of a hydraulic piston and cylinder device 21 having its piston 23 pivotally connected to a crank lever 25 of the arm 13 at 27 and its cylinder pivotally connected to the machine frame at 29. To operate satisfactorily, the arm must effectively be capable of extension and retraction and for this purpose it is generally hollow so as to receive an extendible portion 31 which can be moved between its extended position shown generally at 33 and a retracted position shown generally at 35 under the control of a piston and cylinder device 37 (see FIG. 4) located within the arm.

It will thus be appreciated that in a sweeping cycle, the extendible portion 31 will first of all be extended by the device 37 to its extended position 33, whereupon the extended arm will be swept from its outboard position 17 to its inboard position 19 by extension of the device 21 to sweep mined material across the surface of the apron 7 to a central portion of the apron. On completion of this sweeping movement, the device 37 will be retracted to move the portion 31 to its retracted position 35 whereupon the retracted arm will then be swept from its inboard position to its outboard position again by retraction of the device 21. It will of course be appreciated that by retracting the portion 31, this ensures that swept in material is not swept out again.

Figure 3:
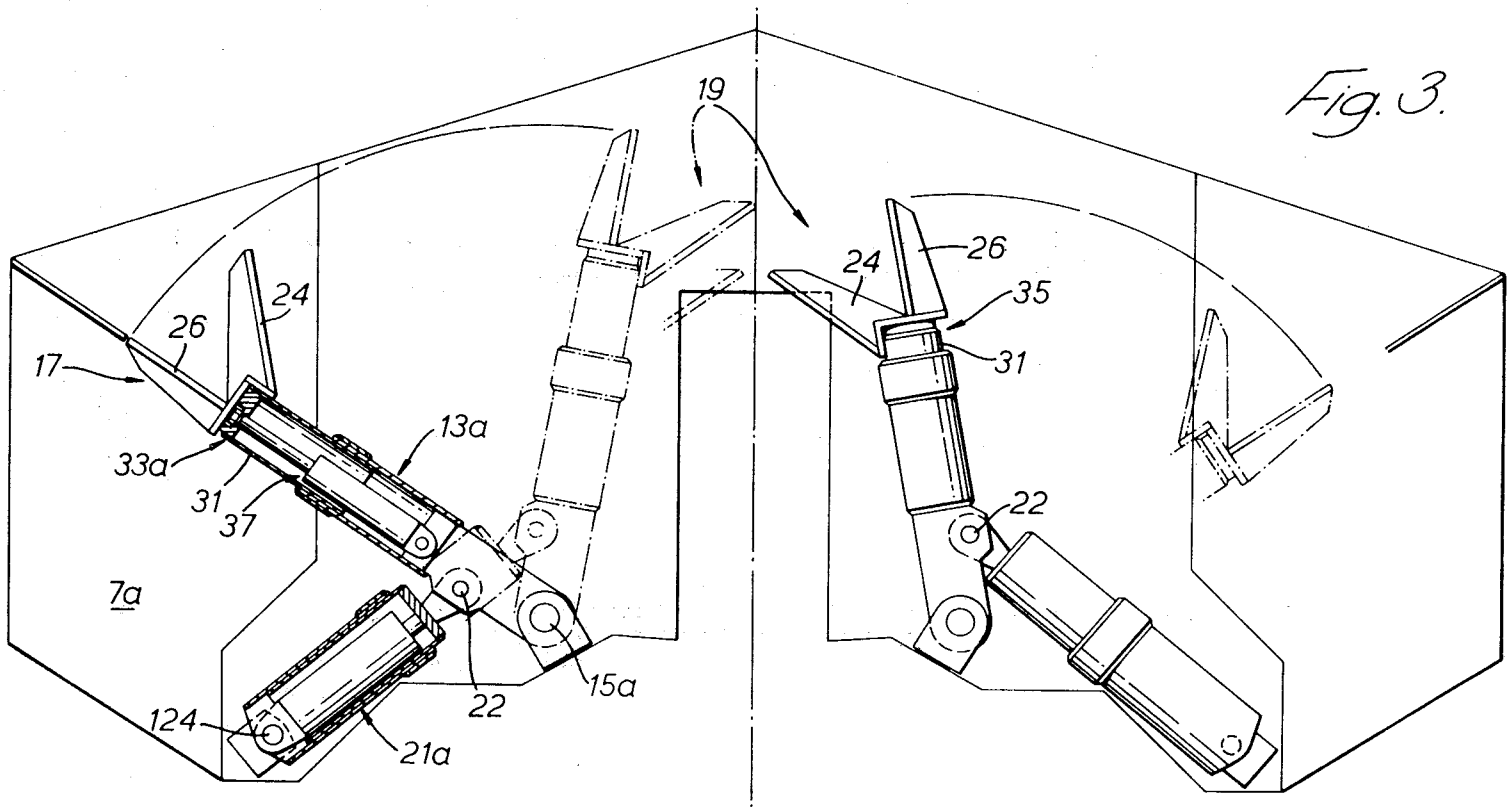
FIG. 3 is a plan view of a preferred embodiment of gathering arms, with the arms being shown in their different positions.

The gathering arms shown in FIGS. 1 and 2 are of very simplete construction and in FIG. 3 an alternative construction is shown which is capable of handling a considerably greater volume of material than the arms of FIGS. 1 and 2. In this construction parts similar to the parts of FIGS. 1 and 2 are identified by the same reference numerals used in those FIGS. but followed by the lower case letter *a*.

However, the extendible portion of the arm 33*a* is in the form of a sleeve slidable on a fixed portion of the arm again under the control of a piston and cylinder device 37 housed wholly within the fixed portion of the arm. However, many different telescopic constructions are possible as will be apparent to any competent engineer. The arms of FIG. 3 differ essentially from those of FIG. 1 in that they are provided with a pair of sweeper blades 24 and 26 supported on portion 33*a*, the blades 24 and 26 being inclined to each other at an angle of about 45°. Preferably, the leading blade 24 is also inclined at an angle of 45° to the longitudinal axis of the arm and the blade 26 is coaxial with the longitudinal axis, although it will be appreciated that the blade 24 could be coaxial and the blade 26 could trail. However, the blade 26, e.g. the trailing blade, should extend outwardly a short distance beyond the blade 24 as illustrated. It will be noted that in this construction, the piston and cylinder devices 21*a* are connected to a point 22 on the arm 13*a*, outboard of the arms pivot point 15*a*, and that the device 21*a* is pivotally connected to the apron 7*a* at 124; this is found more satisfactory and takes up less space than the construction shown in FIG. 1.

In the construction shown in FIGS. 1 and 3 the gathering arms 13, 13*a* are pushed by the piston and cylinder devices 21, 21*a* from their outboard or first position to their inboard or second position. In certain constructions of maining machine, however, it is not possible to mount the devices 21 and 21*a* in the positions illustrated but it is possible to mount them inboard of the gathering arms as illustrated in FIG. 5 by the position of the piston and cylinder device 21*b*. In this construction, the gathering arm 13*b* is shown midway between its outboard position 17*b* and its inboard position 19*b*, the retracted position of its blades 24*b* and 26*b* being shown in full lines and their extended position being shown in broken lines. As will be apparent from FIG. 5, the gathering arm is moved from its outboard position 17*b* to its inboard position 19*b* by a retraction of the device 21*b* rather than by an extension of the device, and vice versa. The fluid circuit shown in FIG. 4 can be used to operate the gathering arm, it merely being necessary to operate the reversing valve 111 to achieve the same operation of the arms as the operation described with reference to FIG. 4 of the construction shown in FIG. 3.

Figure 4:
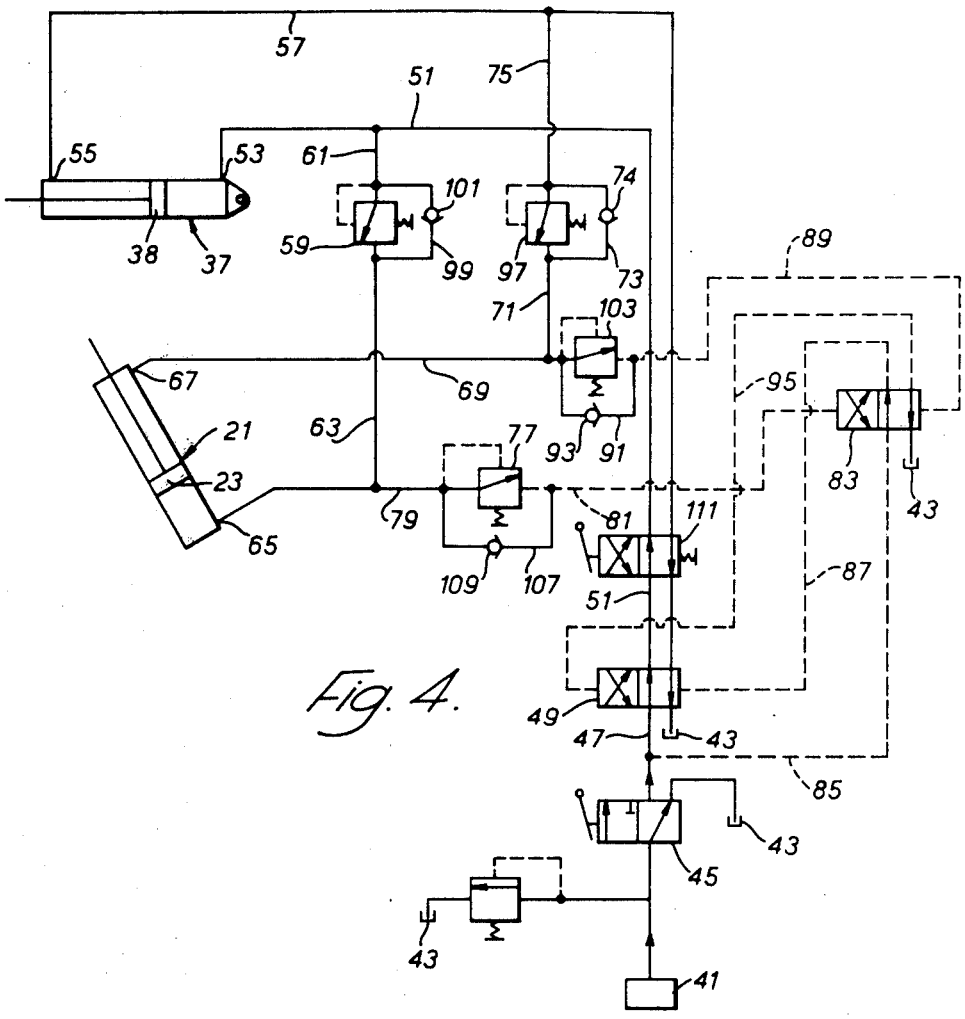
FIG. 4 illustrates a hydraulic circuit for operating a single gathering arm.
Figure 5:
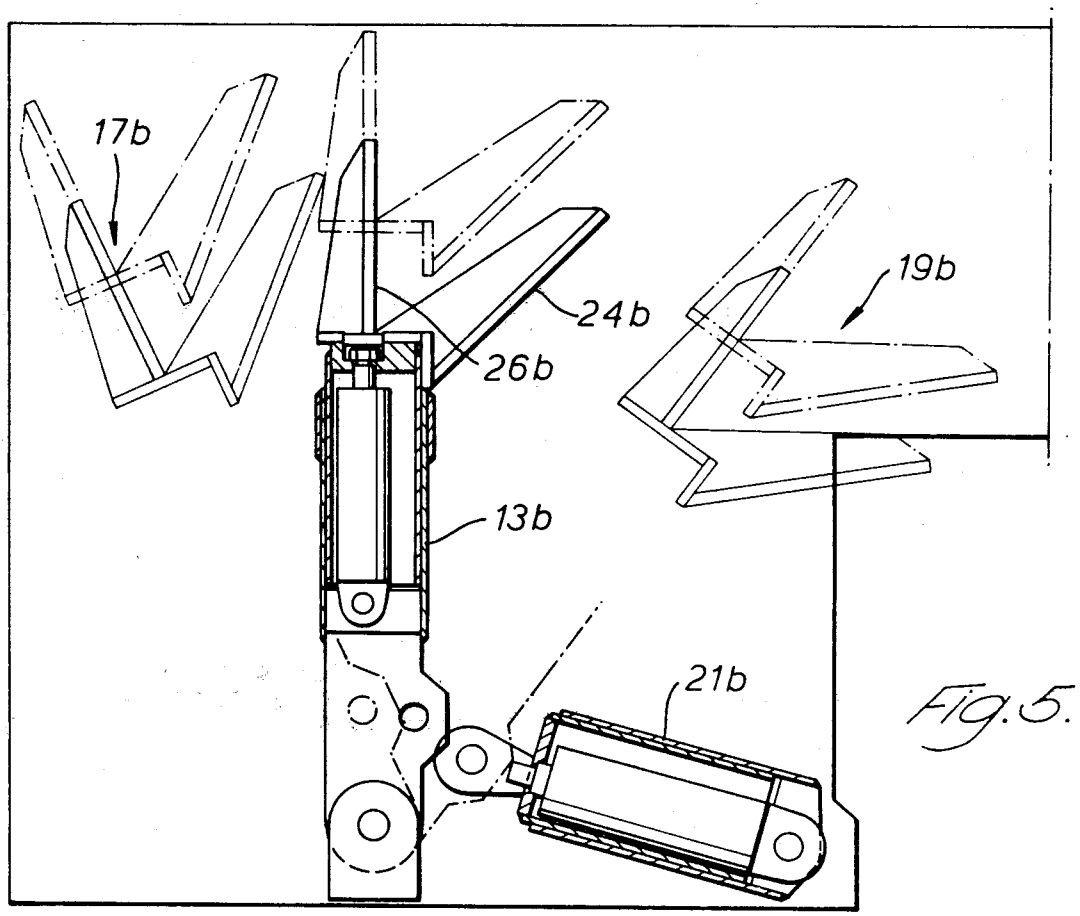
FIG. 5 is a view similar to FIG. 3 but of a different construction showing only one arm.

Referring now to FIG. 4, the hydraulic control circuitry for controlling one gathering arm will be described.

Hydraulic fluid is supplied from a pump 41 either to tank 43 or to the circuit proper by means of a manual control valve 45. With the valve 45 in its illustrated position, the fluid will pass straight to the tank 43 but on shifting of the slide of the valve 45 to the right to its alternative position, fluid can pass through the valve along a line 47, through a first detent valve 49, which is illustrated in a first position, to a further fluid line 51 leading to a port 53 in the cylinder of device 37 so as to communicate with the full area side of its piston 38 so as to move the piston 38 to its extended position, thereby moving the arm 13 to its extended position 33. When in its first position, the first detent valve 49 will allow fluid to escape from the reduced area side of the piston 38 through a port 55 to return through a fluid line 57 to tank 43.

After the device 37 has moved the arm to its extended position 33, there will be a build up of pressure in the line 51 sufficient to move a first sequence valve 59 connected in a line 61 branching off from the line 51 to a position allowing passage of fluid into a line 63 connected to a port 65 in the device 21 communicating with the full area side of the piston 23, thereby moving the device 21 to an extended position to cause sweeping of the arm 13 from its outboard to its inboard position. Escape of fluid from the reduced area side of the piston 23 through a port 67 is possible along a fluid line 69 and a further line 71 communicating with line 57 leading to tank 43 by means of a by-pass line 73 through a non-return valve 74 and a further line 75.

After the device 21 has moved to its extended position there is a build up of pressure in the line 63 and this increased pressure is communicated to a second sequence valve 77 by a line 79 to move the second sequence valve to a position allowing passage of fluid whereupon fluid will flow along a further fluid line 81 to a second detent valve 83 to move its valve slide from its first illustrated position to a second position. The second detent valve when in its first illustrated position allows fluid pressure in the fluid line 47 to pass along a control fluid line 85 through the valve 83 into a further control fluid line 87 and to act upon the slide of the first detent valve 49 to hold it in its first illustrated position.

When the second detent valve is moved from its first illustrated position to its second positions, fluid can escape along a fluid line 89 around a by-pass line 91 and through a non-return valve 93 to the fluid line 71 and hence along line 73 through valve 74 and along lines 75 and 57 to tank.

When the second detent valve has moved to its second position, fluid in the control fluid line 85 will be diverted into a further control fluid line 95 leading to an end of the valve slide of the first detent valve 49 to move this valve from its illustrated first position to a second position, allowing communication between the line 47 and the line 57 and communicating the line 51 with tank 43. The slide of the first detent valve 49 can move due to fluid passing through control fluid line 87 through the second detent valve 83 to tank 43.

As soon as fluid line 47 communicates with line 57, pressure will be applied to the reduced area side of piston 38 via port 55 to move the piston 38 and hence the arm 13 to its withdrawn position 35. Fluid can escape from the full area side of piston 38 through port 53 and line 51 to tank 43. After the piston 38 has moved to its withdrawn position, there is a build up of pressure in the line 57 which is communicated by line 75 to a third sequence valve 97 to move it to a position allowing passage of fluid through the valve to the line 71, along the line 69 to the port 67 in the device 21, into communication with the reduced area side of piston 23 to move it to its withdrawn position and thereby sweep the retracted arm back from its inboard position to its outboard position. Fluid from the full area side of piston 23 can escape through line 63, along a by-pass line 99, through a non-return valve 101, into line 61 and hence to line 51 and back to tank 43.

After the piston 23 has moved to its withdrawn position, there is a build up of fluid pressure in the line 69, causing a fourth sequence valve 103 to move to a position allowing passage of fluid through the valve and into the control fluid line 89 to act upon the end of the slide of the second detent valve 83 to move the valve back from its second to its first illustrated position to begin another sweeping cycle. The valve 83 can move back to its first position because fluid can escape through the control line 81, around a by-pass line 107, through a non-return valve 109, into the line 79, along the line 63, the line 99, through the non-return valve 101 into the line 61, along the line 51 and through the first detent valve 49 to tank. Of course, as soon as the second detent valve 83 has moved to its first illustrated position, pressure control fluid in the line 85 will pass into the line 87 to move the first detent valve 49 back to its illustrated first position.

A spring-loaded manual reversing valve 111 is provided in the fluid line 51.

Although it is envisaged that in certain machines only one gathering arm may be required to sweep mined material from one side of the apron to the other, a pair of arms will normally be required. If the pair of arms are both to move from outboard positions to inboard positions and vice versa, and are to be extended and retracted in unison, then the pair can be operated with the above described circuit merely by connecting an additional device in parallel with each of the illustrated devices 37 and 21. Such an arrangement would not normally be practical because the material being swept to the centre of the apron would tend to mount up at the centre to such an extent that it would prevent the arms reaching their inboard position. Instead, therefore, it is normal to operate the arms somewhat after the fashion of vehicle windscreen wiper blades so that one arm is moving from its outboard to its inboard position and at the same time the other arm is moving from its inboard to its outboard position and hence of course, as one is being extended, the other is being retracted, and vice versa. This can be achieved by providing additional devices "in parallel" with the illustrated devices 37 and 21 but it will of course be appreciated that the device in parallel with the illustrated device 37 will have the full area side of its piston connected to the reduced area side of the piston of device 37 and the reduced area side will hence be connected to the full area side of the piston of device 37. Similar fluid connections will be provided for the additional device connected to the device 21.

What is claimed is:

1. A mining machine comprising a cutting head, a forwardly extending apron located beneath said cutting head, a discharge conveyor associated with said apron, and at least one gathering arm having a first end for pivotal connection to the machine, a first hydraulically operated device pivotally connected to the arm for sweeping said arm through a substantial arc between a first position and a second position, and a second hydraulically operated device supported on said arm for extending and retracting said arm so that it can be extended for sweeping from said first position to said second position and can be retracted again prior to sweeping back from said second position to said first position and a hydraulic control system for controlling the sweeping and extension of said gathering arm, the system including a pump, a main control valve, a first detent valve movable between a first position, for extending said arm and for sweeping said arm from a first to a second position, and a second position for retracting said arm and for sweeping said arm back to its said first position under the control of a second detent valve, said first detent valve, when in its first position, supplying fluid to said second arm extending and retracting device to move it to an extended position, a first sequence valve operative, on movement of said device to its extended position, to permit passage of fluid to said first device to move it from said first position to said second position, a second sequence valve operative, on movement of said first device, to said second position to permit passage of fluid to said second detent valve controlling the position of said first position to its second position, whereupon fluid will be directed to said second arm extending and retracting device to move the latter from its extended position back to its retracted position, a third sequence valve subsequently allowing passage of fluid to the first said device to return it from its second position to its first position, and a fourth sequence valve which will subsequently permit passage of fluid to said second detent valve to move it from its second position back to its first position thereby causing said first detent valve to move back to its first position for a subsequent control cycle.

2. A mining machine as claimed in claim 1 wherein a fluid line extends between said main control valve and said first detent valve and wherein a supply of control fluid to the second detent valve is taken from said fluid line.

3. A mining machine as claimed in claim 1 wherein a fluid by-pass line and a non-return valve are associated with each sequence valve to allow passage of fluid to tank whenever one of the control devices changes position.

4. A mining machine as claimed in claim 1 wherein a springloaded manual reversing valve is provided downstream of the first detent valve.

5. A mining machine comprising a cutting head, a forwardly extending apron located beneath the cutting head, a discharge conveyor associated with said apron, and a pair of gathering arms for sweeping mined material across said apron and on to said discharge conveyor, mounting means pivotally connecting each gathering arm to said apron, one on each side of said discharge conveyor, a first hydraulically operated device pivotally connected to each arm for sweeping said arm through a substantial arc between a first position and a second position, and a second hydraulically operated device supported on each said arm for extending and retracting said arms so that they can be extended for sweeping from said first position to said second position and can be retracted again prior to sweeping back from said second position to said first position, and control means for operating said gathering arms out of phase with each other so that said arms alternatively sweep between outboard positions and inboard positions.

6. A mining machine as claimed in claim 5 wherein said second hydraulically operated device is a piston and cylinder device located within each arm for extending and retracting the arm, the arm being of telescopic construction.

7. A mining machine arm as claimed in claim 5 in which a pair of sweeper blades is provided on an extendible portion of each arm, said blades being inclined to each other at an acute angle with a trailing blade being generally parallel to the longitudinal axis of the arm and extending outwardly beyond the other blade.

8. A mining machine as claimed in claim 5 wherein said first hydraulically operated devices comprise piston and cylinder devices for moving said gathering arms between inboard and outboard positions, and wherein a piston rod of one of said hydraulically operated piston and cylinder devices is pivotally connected to each gathering arm and a cylinder of each of said devices is pivotally connected to said apron.

* * * * *